US006759923B1

(12) United States Patent
Scott et al.

(10) Patent No.: US 6,759,923 B1
(45) Date of Patent: Jul. 6, 2004

(54) DEVICE FOR DIRECTING ENERGY, AND A METHOD OF MAKING SAME

(75) Inventors: Gordon R. Scott, Plano, TX (US); Teresa R. Robinson, Garland, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/079,768

(22) Filed: Feb. 19, 2002

(51) Int. Cl.[7] ..... H01P 5/18; H01P 3/08
(52) U.S. Cl. ..... 333/116; 333/238
(58) Field of Search ..... 333/116, 238

(56) References Cited

U.S. PATENT DOCUMENTS

| | | | | |
|---|---|---|---|---|
| 3,512,110 A | | 5/1970 | Clar | |
| 4,288,761 A | * | 9/1981 | Hopfer | 333/116 |
| 4,902,990 A | | 2/1990 | Cicso | |
| 5,008,639 A | | 4/1991 | Pavio | |
| 5,446,425 A | * | 8/1995 | Banba | 333/116 |
| 5,625,169 A | * | 4/1997 | Tanaka | 174/250 |
| 5,834,991 A | | 11/1998 | Mazzochette | |
| 5,894,252 A | * | 4/1999 | Oida | 333/202 |
| 6,528,732 B1 | * | 3/2003 | Okubora et al. | 174/255 |

FOREIGN PATENT DOCUMENTS

| | | |
|---|---|---|
| DE | 198 37 025 A1 | 2/2000 |
| JP | 63 286006 A | 3/1989 |
| WO | WO 98/12769 | 3/1998 |

OTHER PUBLICATIONS

Lange, Julius, "Interdigitated Stripline Quadrature Hybrid", IEEE Transactions on Microwave Theory and Techniques, Dec., 1969, pp. 1150–1151.

Pavio, et al., "A Microstrip Re–Entrant Mode Quadrature Coupler for Hybrid and Monolithic Circuit Applications", IEEE MIT–S Digest, 1990, pp. 573–576.

* cited by examiner

*Primary Examiner*—Patricia Nguyen
(74) *Attorney, Agent, or Firm*—Baker Botts L.L.P.

(57) ABSTRACT

A hybrid coupler (10, 90, 110, 130, 160, 210) includes a substrate (12) having a coupling structure formed thereon using thick film processing techniques. The coupling structure includes two parallel conductive strips (21, 31). One strip (21) is coupled at one end to an incident port (22) and at the other end to a direct port (23). The other strip (31) is coupled at one end to a coupled port (32) and at the other end to an isolated port (33). An electrically conductive shield (71, 91, 111, 164) is aligned with and enhances coupling between the conductive strips. A dielectric layer (61, 162) is provided between the shield and the conductive strips.

15 Claims, 4 Drawing Sheets

DEVICE FOR DIRECTING ENERGY, AND A METHOD OF MAKING SAME

TECHNICAL FIELD OF THE INVENTION

This invention relates in general to devices for directing energy and, more particularly, to a hybrid coupler which is part of an integrated circuit and which is capable of directing microwaves or other energy.

BACKGROUND OF THE INVENTION

Passive power couplers are a fundamental type of integrated circuit device used in many high frequency signal processing systems, such as microwave systems. Applications include balanced mixers, balanced amplifiers, phase shifters, attenuators, modulators, discriminators, and measurement bridges. An ideal hybrid coupler is a junction having four ports, which are commonly known as the incident port, the direct port, the coupled port, and the isolated port. Energy of a wave applied to the incident port is supplied to each of the direct port and the coupled port, but not to the isolated port. The amount of the input energy coupled to each of the direct and coupled ports may be about the same, or may differ according to some selected proportion.

In recent years, there has been a significant increase in the typical operating frequencies of leading edge systems which use these hybrid couplers. In particular, typical operating frequencies have increased by factors in the range of 3 to 6, for example from a typical frequency of about 3 GHz to a typical frequency in the range of about 10–18 GHz. As these frequencies have increased, it has been necessary for the size of the couplers to decrease. As a result, a broadband microwave hybrid coupler typically requires small dimensions within the coupled structure, in order to achieve tight coupling across a relatively wide frequency range. These small dimensions are commonly achieved using known types of opto-lithographic techniques, which are commonly referred to in the art as thin film technology. While couplers made with thin film technology have been generally adequate for the their intended purposes, they have not been satisfactory in all respects.

One aspect of this is that the fabrication of couplers using thin film technology involves an undesirably high cost. One less expensive fabrication technique used for other types of integrated circuits involves screen printing techniques rather than opto-lithographic techniques, and is commonly known in the art as thick film processing. However, while thick film technology is generally cheaper, the fabrication tolerances are looser for thick film technology than for thin film technology. Consequently, because small and accurate dimensions have been needed in pre-existing high-frequency coupler designs, the industry has generally considered it impractical to implement hybrid couplers using thick film techniques, especially for high-frequency applications such as microwave systems.

SUMMARY OF THE INVENTION

From the foregoing, it may be appreciated that a need has arisen for a hybrid coupler which can be made by thick film techniques, with good production yields and with good performance characteristics. According to one form of the present invention, an apparatus is provided to address this need, and involves a coupler which includes: a thick film dielectric layer having first and second sides; a thick film first strip made of an electrically conductive material and disposed on the first side of the dielectric layer; a thick film second strip made of an electrically conductive material and disposed on the first side of the dielectric layer, the first and second strips extending approximately parallel to each other; and a thick film shield made of an electrically conductive material and disposed on the second side of the dielectric layer in alignment with the first and second strips.

According to a different form of the present invention, a method of making a coupler involves: forming a dielectric layer using a thick film technique, the dielectric layer having first and second sides; forming a first strip which is electrically conductive using a thick film technique, the first strip being disposed on the first side of the dielectric layer; forming a second strip which is electrically conductive using a thick film technique, the second strip being disposed on the first side of the dielectric layer, and the first and second strips extending approximately parallel to each other; and forming a shield which is electrically conductive using a thick film technique, the shield being disposed on the second side of the dielectric layer in alignment with the first and second strips.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
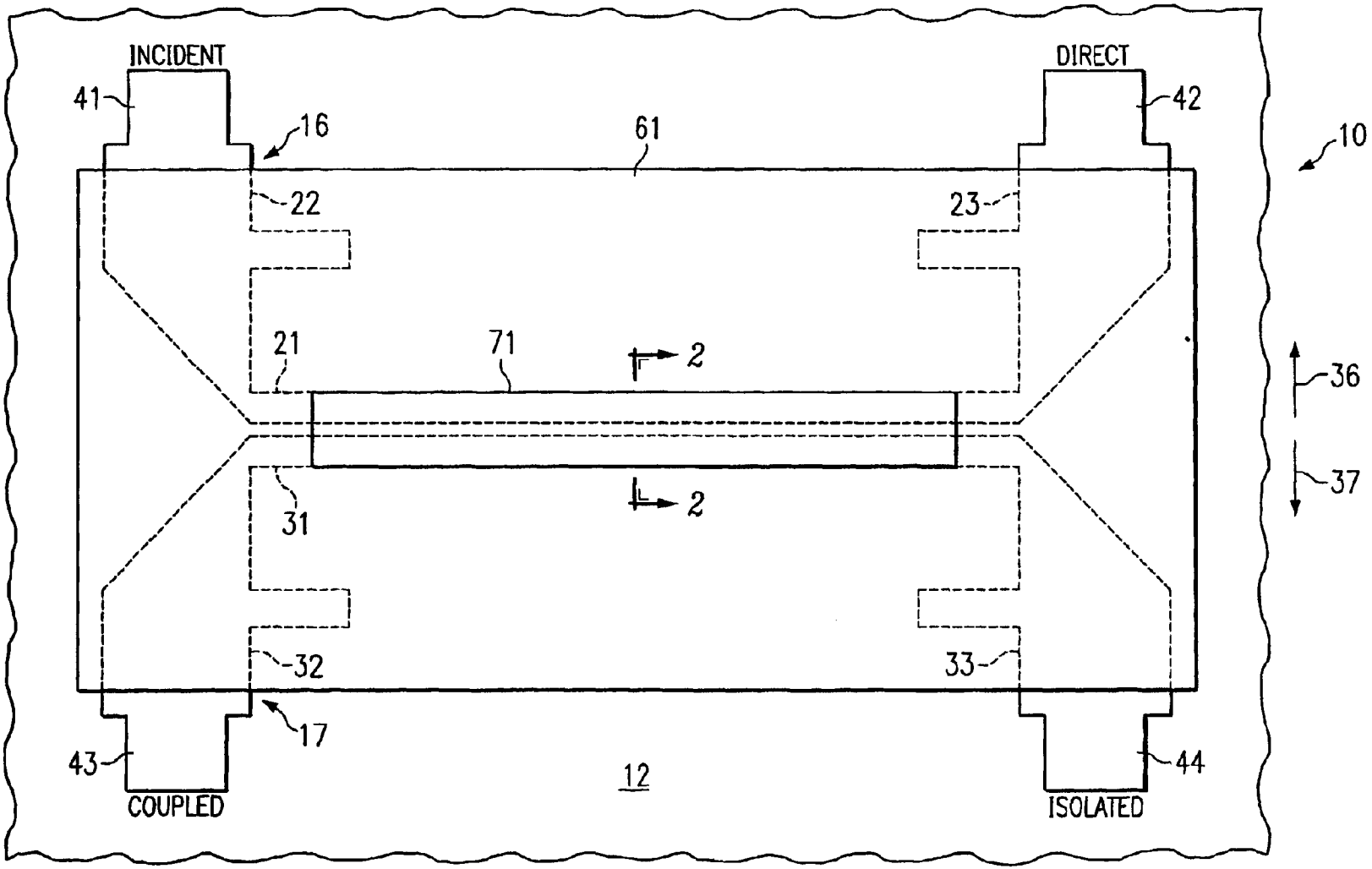
FIG. 1 is a diagrammatic fragmentary top view of an integrated circuit with a coupler which embodies the present invention.
Figure 2:
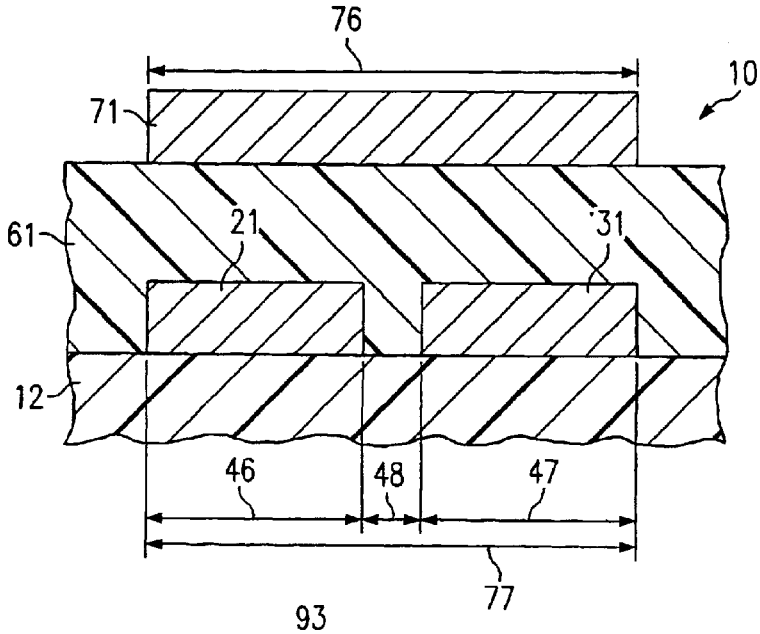
FIG. 2 is a diagrammatic fragmentary sectional view taken along the section line 2—2 in FIG. 1.

In order to more clearly convey an understanding of the present invention, certain features in the drawings are not shown to scale. With this in mind, FIG. 1 is a diagrammatic fragmentary top view of an apparatus which is part of an integrated circuit that implements a hybrid coupler 10, where the coupler 10 embodies aspects of the present invention. FIG. 2 is a diagrammatic fragmentary sectional view taken along the section line 2—2 in FIG. 1. The coupler 10 includes a substrate 12, which in the disclosed embodiment is alumina. However, the substrate 12 could alternatively be made of some other suitable material, such as aluminum nitride or beryllium oxide. The substrate 12 has on the underside thereof a not-illustrated ground plane of a standard type, in order to facilitate operation of microstrip structure which is described below.

More specifically, two separate electrically conductive sections 16 and 17 are formed top of the substrate 12. The conductive sections 16 and 17 are each formed by thick film techniques of a type known in the art, which involve screen-printing the conductive sections 16 and 17 onto the substrate 12. The conductive sections 16 and 17 each have a thickness of approximately 300 microns, but could alternatively have some other suitable thickness which is compatible with formation by thick film techniques. In the disclosed embodiment, the conductive sections 16 and 17 are each made of gold, but could alternatively be made of some other suitable material which is electrically conductive, such as a different type of metal.

The conductive section 16 includes an elongate strip 21, an incident port 22 at one end of the strip 21, and a direct port 23 at the other end of the strip 21. The strip 21 and the ports 22–23 are respective integral portions of the conductive section 16. In a similar manner, the conductive section 17 includes an elongate strip 31, a coupled port 32 at one end of the strip 31, and an isolated port 33 at the other end of the strip 31. The strip 31 and the ports 32–33 are respective integral portions of the conductive section 17. The strip 31 is spaced a small distance from and extends parallel to the strip 21, such that the adjacent edges of the strips 21 and 31 extend parallel to each other. The strips 21 and 31 serve as a pair of microstrip coupled lines.

The ports 22 and 23 extend from respective ends of the strip 21 in a direction away from the strip 31, and thus extend approximately in a direction 36 which is transverse to the strips 21 and 31. The ports 32 and 33 extend from respective ends of the strip 31 in a direction away from the strip 21, and thus extend approximately in a direction 37 which is transverse to the strips 21 and 31, and which is opposite to the transverse direction 36. The ports 22, 23, 32 and 33 each have at the outer end thereof a respective portion 41–44, which serves as a terminal or pad to which external electrical connections can be made.

With reference to FIG. 2, the strips 21 and 31 have respective widths 46 and 47. In the disclosed embodiment, the widths 46 and 47 are approximately equal, and are each about 0.004 inches. The lateral spacing or gap 48 between the strips 21 and 31 is approximately 0.002 inches in the disclosed embodiment, but could alternatively be some other suitable dimension.

A layer 61 of a dielectric material is provided over part of the substrate 12, and over the conductive sections 16 and 17, except for the terminals 41–44 at the ends thereof. The dielectric layer 61 is formed using thick film techniques of a known type. In the disclosed embodiment, the dielectric layer 61 has a thickness of approximately 0.0005 inches, but it could alternatively have some other suitable thickness which is compatible with formation by thick film techniques. As shown in FIG. 1, the dielectric layer 61 of the disclosed embodiment has an approximately rectangular shape. The terminals 41–44 of the four ports each project transversely outwardly beyond edges of the dielectric layer 61.

In the disclosed embodiment, the dielectric layer 61 is made of a borosilicate glass material which has a dielectric constant of 3.9, and which is commercially available under catalog number KQ125 from Haraeus, Inc. of West Conshohocken, Pa. However, it could alternatively be made from some other suitable dielectric material.

An electrically conductive shield 71 is formed on top of the dielectric layer 61. The shield 71 is formed using thick film techniques of a known type. In the disclosed embodiment the shield 71 is made of gold, but it could alternatively be made of some other suitable material which is electrically conductive, such as a different metal. The shield 71 in the disclosed embodiment has a thickness of approximately 300 microns, but it could alternatively have some other thickness which is compatible with formation by thick film techniques.

As shown in FIG. 1, the shield 71 has a shape which is an elongated rectangle. The shield 71 is centered over the conductive strips 21 and 31, and extends almost the entire length thereof. With reference to FIG. 2, the shield 71 has a width 76 which is approximately equal to the distance 77 between the outer edges of the strips 21 and 31. However, the shield 71 could have a different width 76, as discussed in more detail later.

As mentioned above, certain aspects of FIG. 2 are not to scale. As one example, the thickness of the shield 71 and the thicknesses of the strips 21 and 31 are greatly exaggerated in proportion to the thickness of the dielectric layer 61. As a practical matter, it will be recognized that the vertical distance between the shield 71 and the strips 21 and 31 is approximately equal to the thickness of the dielectric layer 61.

During operational use, energy of a wave supplied to the incident port 22 is split between the direct port 23 and the coupled port 32, in a selected proportion which is determined by the design, as discussed later. Ideally, all of the energy from the incident port would be split between the direct port and the coupled port, and none would reach the isolated port 33. As a practical matter, however, a small portion of this energy reaches the isolated port 33.

Due to the fact that the coupler 10 is formed using thick film techniques, the spacing or gap 48 between the conductive strips 21 and 31 is necessarily larger than would be the case if the coupler was made using a thin film technique. This is due to the fact that dimensions and tolerances are more precise with thin film technology than with thick film technology. And since the use of thick film techniques renders the space or gap 48 in the disclosed embodiment larger than would be the case in an embodiment made using thin film techniques, electromagnetic coupling between the conductive strips 21 and 31 would be expected to be somewhat less than for the conductive strips of a thin film coupler, where the strips could be closer to each other.

In the disclosed embodiment, however, the presence of the shield 71 is effective to significantly increase the level of electromagnetic coupling of energy from the strip 21 to the strip 31, so that the coupling has a suitable level even when the strips 21 and 31 are spaced further apart than would be the case in pre-existing devices. And since the shield 71 permits the gap 48 to be larger than would be practical if the shield 71 was omitted, the larger gap allows a reduction in manufacturing tolerances which avoids the need for thin film technology and instead permits the disclosed coupler to be readily fabricated with low-cost thick film technology. In terms of manufacturing variations, the disclosed coupler 10 permits a fair degree of manufacturing variations with minimal performance degradation. The result is a broadband coupler 10 that can be made with thick film techniques while providing high manufacturing yields.

Figure 3:
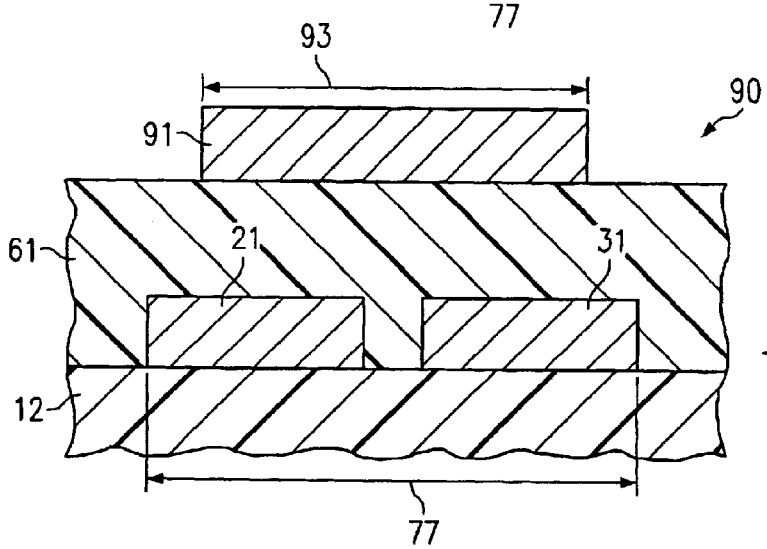
FIG. 3 is a diagrammatic fragmentary sectional view similar to FIG. 2, but showing a coupler which is an alternative embodiment of the coupler of FIG. 2.

FIG. 3 is a diagrammatic fragmentary sectional view of a hybrid coupler 90 which is an alternative embodiment of the coupler 10 of FIGS. 1–2. The coupler 90 is effectively identical to the coupler 10, except that it has a shield 91 with a width 93 which is less than the width 76 of the shield 71 in FIGS. 1–2. Thus, the width 93 of the shield 91 is less than the distance 77 between the outer edges of the conductive strips 21 and 31. Like the shield 71 of FIG. 2, the shield 91 of FIG. 3 is formed using thick film techniques, and significantly enhances coupling between the conductive strips 21 and 31, in comparison to a situation where the shield 91 was omitted. But the shield 91 of FIG. 3 provides somewhat less coupling than the shield 71 of FIG. 2, due to the fact that it has a smaller width.

It will thus be recognized that adjusting the width of the shield is a design technique which can be used to set or tune the amount of coupling between the coupling strips 21 and 31, thus adjusting the proportional relationship defining how energy from the incident port 22 is split between the direct port 23 and the coupled port 32. Other design techniques which can be used to adjust the amount of coupling between the strips 21 and 31 involve variation of the gap 48 (FIG. 2) provided between the conductive strips 21 and 31, variation of the thickness of the dielectric layer 61 that separates the strips 21 and 31 from the shield 71 or 91, and/or use of a different dielectric material with a different dielectric constant for the dielectric layer 61. Varying the widths of the conductive strips 21 and 31 can vary the return loss, and can also have some effect on the degree of coupling between the strips. The length of the conductive strips 21 and 31 can be varied in order to vary the frequency band within which the coupler 10 operates.

Figure 4:
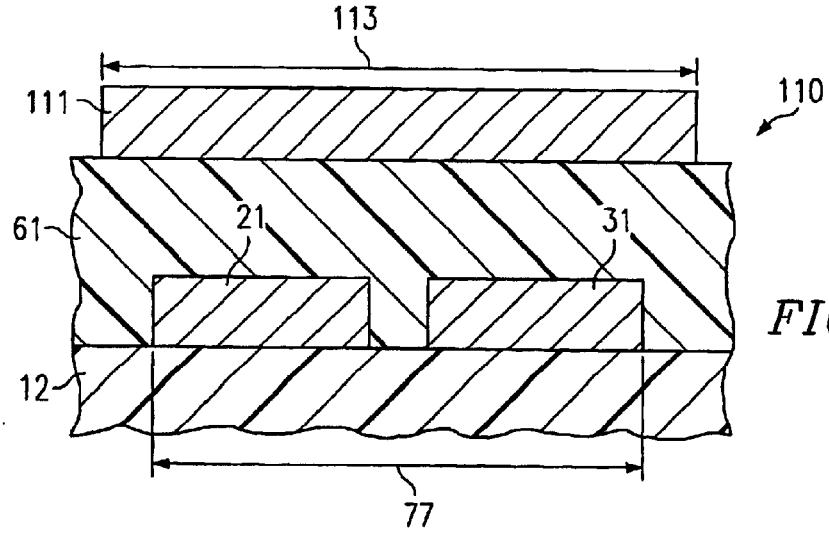
FIG. 4 is a diagrammatic fragmentary sectional view similar to FIG. 2, but showing a coupler which is yet another alternative embodiment of the coupler of FIG. 2.

FIG. 4 is a diagrammatic fragmentary sectional view similar to FIGS. 2 and 3, but showing a hybrid coupler 110 which is yet another alternative embodiment of the coupler 10 of FIG. 2. The coupler 110 is effectively identical to the coupler 10, except that it has a shield 111 with a width 113 which is greater than the width 76 of the shield 71 in FIG. 2. Consequently, the shield 111 of FIG. 4 provides a greater degree of coupling between the strips 21 and 31 than the shield 71 of FIG. 2. The shield 111 is formed using thick film techniques, and is effectively identical to the shield 71 of FIGS. 1–2, except for the fact that the shield 111 is wider than the shield 71.

Figure 5:
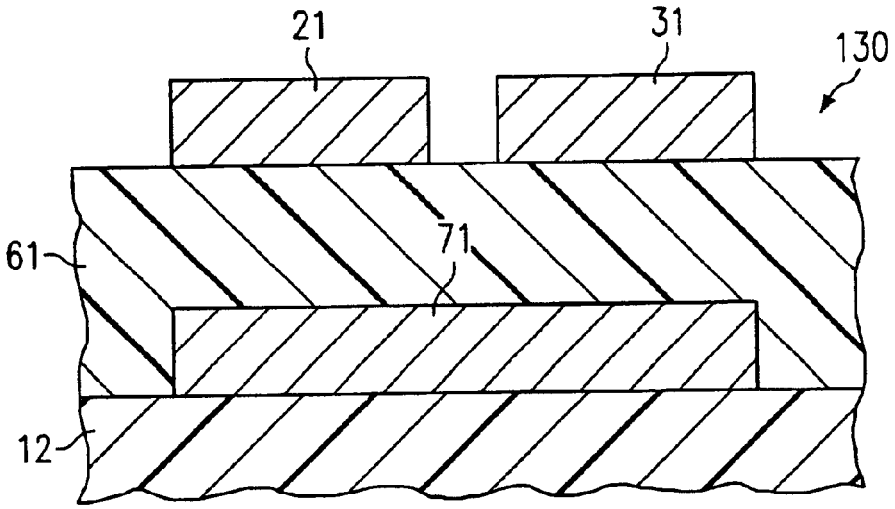
FIG. 5 is a diagrammatic fragmentary sectional view similar to FIG. 2, but showing a coupler which is still another alternative embodiment of the coupler of FIG. 2.

FIG. 5 is a diagrammatic fragmentary sectional view of a hybrid coupler 130 which is still another alternative embodiment of the coupler 10 of FIG. 2. The coupler 130 of FIG. 5 is effectively identical to the coupler 10 of FIG. 2, except that the locations of the shield 71 and the conductive strips 21 and 31 have been swapped. In particular, the shield 71 is provided between the substrate 12 and the dielectric layer 61, and the strips 21 and 31 are provided on the upper side of the dielectric layer 61. The shield 71 of FIG. 5 has the same width and thickness as the shield 71 in FIG. 2, the dielectric layer 61 of FIG. 5 has the same thickness as the dielectric layer 61 in FIG. 2, the conductive strips 21 and 31 have the same widths and thicknesses as the strips 21 and 31 in FIG. 2, and the space or gap between the conductive strips 21 and 31 in FIG. 5 is the same as in FIG. 2. Further, the coupler 130 operates in substantially the same manner as the coupler 10 of FIG. 2, with similar performance characteristics.

Figure 6:
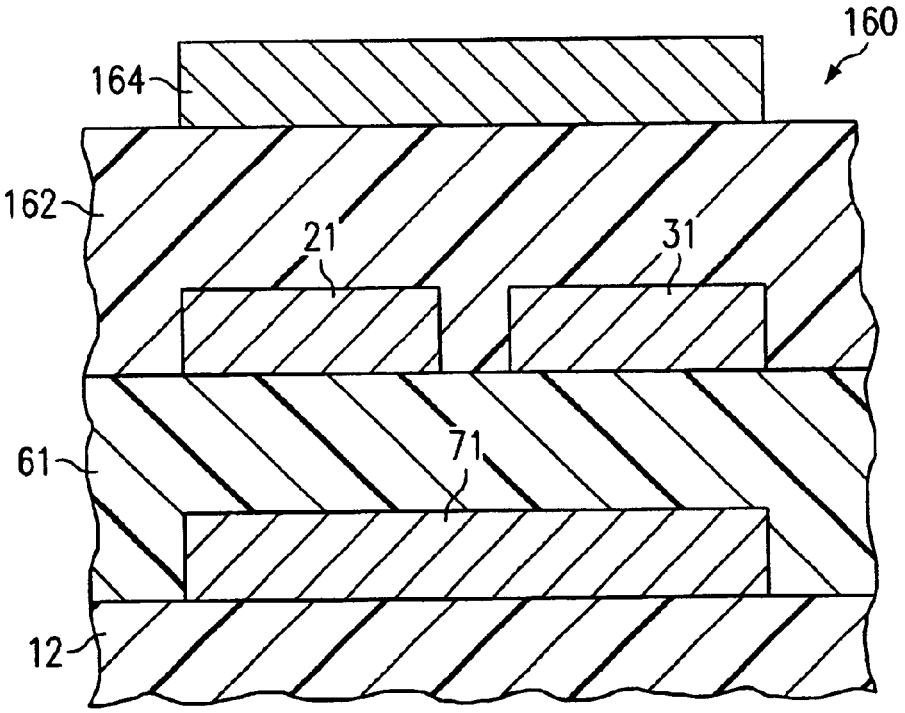
FIG. 6 is a diagrammatic fragmentary sectional view similar to FIG. 5, but showing a coupler which is an alternative embodiment of the coupler of FIG. 5.

FIG. 6 is a diagrammatic fragmentary sectional view of a coupler 160 which is an alternative embodiment of the coupler 130 of FIG. 5. The coupler 160 includes a portion which is structurally identical to the coupler 130 shown in FIG. 5. The coupler 160 also has some additional structure. The additional structure includes a second dielectric layer 162 which is provided over the conductive strips 21 and 31 and over the dielectric layer 61, and also includes a further shield 164 which is provided on top of the dielectric layer 162. The dielectric layer 162 and the shield 164 are each formed using thick film techniques of a type known in the art.

The dielectric layer 162 in FIG. 6 has the same thickness as the dielectric layer 61, but could alternatively have a different thickness which is compatible with formation of the dielectric layer 162 using thick film techniques. The dielectric layer 162 in FIG. 6 is made from the same material as the dielectric layer 61, but could alternatively be made from some other suitable material. The shield 164 in FIG. 6 has the same thickness, width and length as the shield 71 of FIG. 6, and is aligned above the shield 71. Alternatively, however, the shield 164 could have a different thickness or a different length or width, within limits compatible with thick film techniques. The shield 164 in FIG. 6 is made from the same electrically conductive material as the shield 71, but could alternatively be made from some other suitable material.

The provision of two shields 71 and 164 with the conductive strips 21 and 31 therebetween provides significantly enhanced coupling between the conductive strips 21 and 31, in comparison to the embodiment of FIG. 5. Thus, providing a second shield is yet another design technique which can be used in a thick film coupler to set or tune the amount of coupling between the strips 21 and 31, thereby controlling the manner in which energy from the incident port is proportionally split between the direct port and coupled port.

Due to the additional coupling effect provided by the presence of two shields 71 and 164, it would also be possible to increase the thicknesses of both dielectric layers 61 and 162, while maintaining a suitable degree of it coupling between the strips 21 and 31. The thicker dielectric layers would serve to reduce the possibility of a pinhole short extending from either shield 71 or 164 to either strip 21 or 31.

Figure 7:
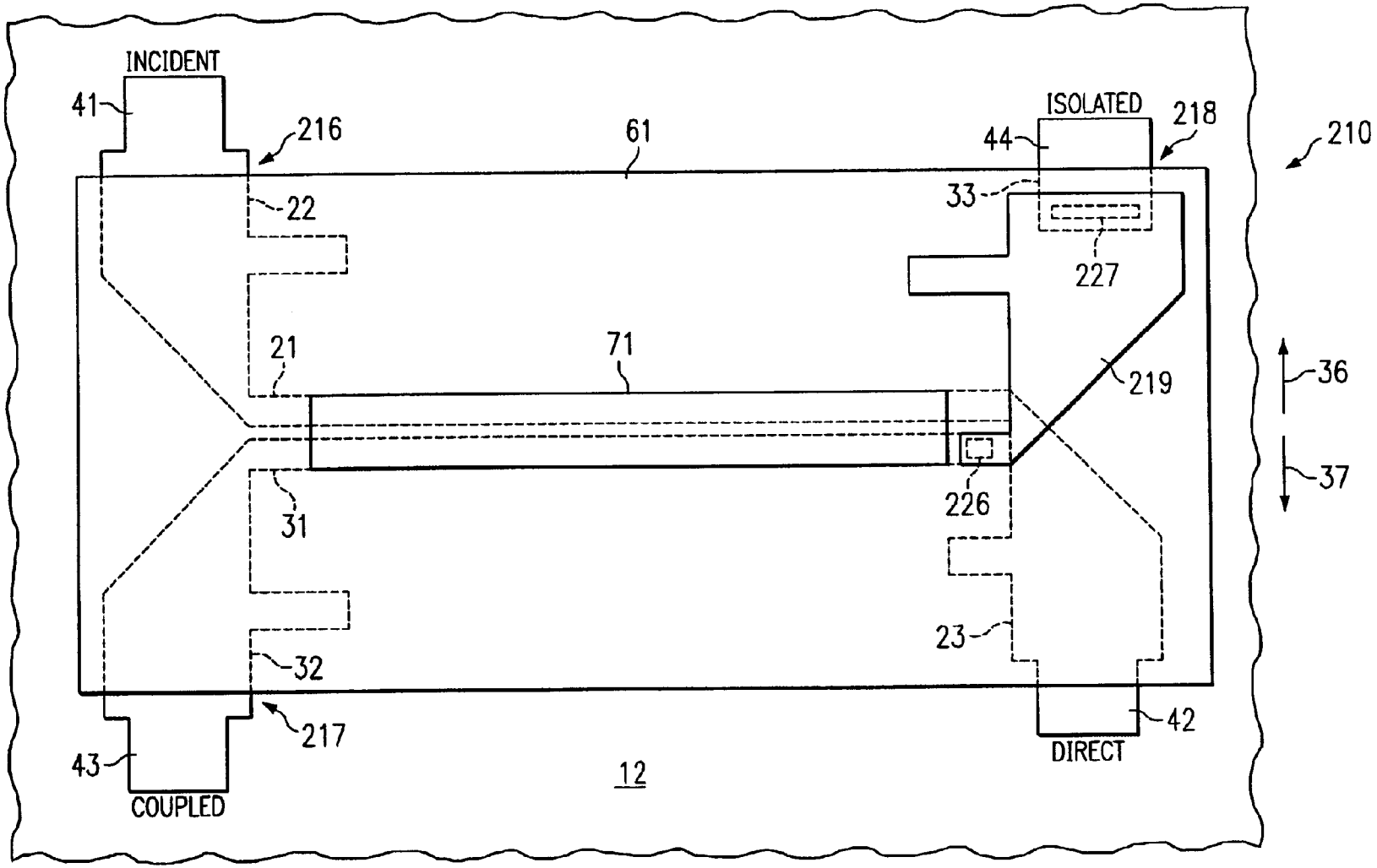
FIG. 7 is a diagrammatic fragmentary top view similar to FIG. 1, but showing an integrated circuit with a coupler which is yet another alternative embodiment of the coupler of FIG. 1.

FIG. 7 is a diagrammatic fragmentary top view similar to FIG. 1, but showing a coupler 210 which is an alternative embodiment of the coupler 10 of FIG. 1. The coupler 210 of FIG. 7 is effectively identical to the coupler 10 of FIG. 1, except for differences which are discussed below.

The coupler 210 includes an electrically conductive section 216, with respective integral portions that include the strip 21, the incident port 22 with terminal 41, and the direct port 23 with terminal 42. The conductive section 216 differs from the conductive section 16 of FIG. 1 primarily in that the direct port 23 extends away from the right end of the strip 21 approximately in the transverse direction 37 rather than in the transverse direction 36.

The coupler 210 also includes a further electrically conductive section 217, with respective integral portions that include the conductive strip 31, and the coupled port 32 with terminal 43. The conductive section 217 of FIG. 7 differs from the conductive section 17 of FIG. 1 primarily in that the conductive section 217 ends at the right end of the strip 31, whereas the conductive section 17 in FIG. 1 has the isolated port 33 connected directly and integrally to the right end of the strip 31. In the coupler 210 of FIG. 7, the isolated port 33 with terminal 44 is provided on the substrate 12 in the form of a further electrically conductive section 218 of approximately square shape, the isolated port 33 being spaced approximately in the transverse direction 36 from the right end of the conductive strip 31.

The coupler 210 includes still another electrically conductive section 219. The conductive section 219 is provided on top of the dielectric layer 61, rather than between the substrate 12 and the dielectric layer 61, and can be formed at the same time as the shield 71. The conductive section 219 has one end disposed over the right end of the strip 31, and its other end disposed over the inner end of the isolated port 33. An electrically conductive via 226 extends vertically through the dielectric layer 61, and electrically couples the right end of the strip 31 to the end of the conductive section 219 disposed above it. A further electrically conductive via 227 extends vertically through the dielectric layer 61, and electrically couples the opposite end of the conductive section 219 to the inner end of the isolated port 33. The conductive section 219 extends approximately in the transverse direction 36, from the via 226 to the via 227.

The conductive sections 216–219 and the vias 226–227 are each formed using thick film techniques of a known type. The conductive sections 216–219 are each made of gold, and each have a thickness of about 300 microns. Alternatively, however, they could be made of some other suitable conductive material, and/or could have some other suitable thickness compatible with formation by thick film techniques. The vias 226–227 are made from gold, but could alternatively be made from some other suitable material.

A significant difference between the coupler 210 of FIG. 7 and the coupler 10 of FIG. 1 is that the locations of the direct and isolated ports 23 and 33 have effectively been swapped. As a result, in FIG. 7, the direct port 23 and the coupled port 32 are both on the same side of the coupler 210. This facilitates use of the coupler 210 with a category of circuits known as balanced circuits, examples of which are a balanced filter, a balanced amplifier, a balanced phase shifter, and a balanced attenuator. Aside from the fact that the positions of the direct and isolated ports are swapped, the coupler 210 operates in substantially the same manner as described above for the coupler 10, and provides comparable performance.

The present invention provides a number of technical advantages. One such technical advantage results from the provision of a hybrid coupler which is implemented using low-cost thick film technology, while providing a suitable degree of coupling. A related advantage relates to the use of a floating conductive shield in the region of the coupled structure, with a dielectric layer between the shield and the coupling structure. The shield significantly increases the degree of coupling, thereby permitting a gap between the coupled structure to be sufficiently large to permit implementation by thick film processing.

Still another advantage is that the coupler design tolerates a fair degree of manufacturing variations without exhibiting a significant variation in performance characteristics. A related advantage is that the coupler provides broadband performance, and can be manufactured with high yields at low cost using thick film techniques.

Although selected embodiments have been illustrated and described in detail, it will be understood that various substitutions and alterations are possible without departing from the spirit and scope of the present invention, as defined by the following claims.

What is claimed is:

1. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other; and a thick film shield made of an electrically conductive material and disposed on said second side of said dielectric layer in alignment with said first and second strips;

including thick film first, second, third, and fourth port portions which are made of an electrically conductive material and which are disposed on said first side of said dielectric layer, said first and second port portions being respectively electrically coupled to first and second ends of said first strip and extending away from said second strip, and said third and fourth port portions being respectively electrically coupled to first and second ends of said second strip and extending away from said first strip, said first and second port portions being wider than said first strip.

2. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other; and a thick film shield made of an electrically conductive material and disposed on said second side of said dielectric layer in alignment with said first and second strips;

including thick film first, second, third, and fourth port portions which are made of an electrically conductive material and which are disposed on said first side of said dielectric layer, said first and second port portions being respectively electrically coupled to first and second ends of said first strip and extending away from said second strip, and said third and fourth port portions being respectively electrically coupled to first and second ends of said second strip and extending away from said first strip;

a substrate disposed adjacent said first side of said dielectric layer, said first and second strips being disposed between said substrate and said dielectric layer, said substrate having a different dielectric constant than said dielectric layer.

3. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other; and a thick film shield made of an electrically conductive material and disposed on said second side of said dielectric layer in alignment with said first and second strips;

including thick film first, second, third, and fourth port portions which are made of an electrically conductive material and which are disposed on said first side of said dielectric layer, said first and second port portions being respectively electrically coupled to first and second ends of said first strip and extending away from said second strip, and said third and fourth port portions being respectively electrically coupled to first and second ends of said second strip and extending away from said first strip;

a substrate disposed adjacent said second side of said dielectric layer, said shield being disposed between said substrate and said dielectric layer.

4. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other;

a thick film shield made of an electrically conductive material and disposed on said second side of said dielectric layer in alignment with said first and second strips;

a substrate disposed adjacent said second side of said dielectric layer, said shield being disposed between said substrate and said dielectric layer;

a thick film further dielectric layer, said first and second strips being disposed between said dielectric layers; and a thick film further shield disposed on a side of said further dielectric layer opposite from said substrate and in alignment with said first and second strips.

5. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other;

a thick film shield made of an electrically conductive material and disposed on said second side of said dielectric layer in alignment with said first and second strips;

wherein said shield has a width which is approximately equal to a distance between outer edges of said first and second strips.

6. An apparatus according to claim 1, wherein said shield has a width which is greater than a distance between outer edges of said first and second strips.

7. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other;

a thick film shield made of an electrically conductive material and disposed on said second side of said dielectric layer in alignment with said first and second strips;

wherein said shield has a width which is less than a distance between outer edges of said first and second strips.

8. An apparatus according to claim 1, wherein the first, second, third, and fourth port portions are exposed from the dielectric layer.

9. An apparatus according to claim 8, wherein the first, second, third, and fourth port portions include a terminal portion to allow electrical connections to be made.

10. An apparatus comprising a coupler which includes:

a thick film dielectric layer having first and second sides;

a thick film first strip made of an electrically conductive material and disposed on said first side of said dielectric layer;

a thick film second strip made of an electrically conductive material and disposed on said first side of said dielectric layer, said first and second strips extending approximately parallel to each other;

a thick film shield made of an electrically conductive material and disposed on said second side of said dielectric layer in alignment with said first and second strips;

wherein said first and second strips each have first and second ends, said first ends of said strips being adjacent and said second ends of said strips being adjacent;

including thick film first, second, third and fourth port portions which are made of an electrically conductive material and which are disposed on said first side of said dielectric layer, said first and second port portions being respectively electrically coupled to said first and second ends of said first strip, and said third port portion being electrically coupled to said first end of said second strip;

including a further portion which is made of an electrically conductive material, which is disposed on said second side of said dielectric layer, and which has first and second ends; and including electrically conductive first and second vias which extend through said dielectric layer at spaced locations, said first via electrically coupling said first end of said further portion to said fourth port portion, and said second via electrically coupling said second end of said further portion to said second end of said second strip.

11. An apparatus according to claim 10, wherein said first and second port portions and said first strip are respective integral portions of a single conductive part;

wherein said third port portion and said second strip are respective integral portions of a single conductive part;

wherein said first port portion extends away from said first end of said first strip and away from said second strip approximately in a first transverse direction;

wherein said second port portion extends away from said second end of said first strip approximately in a second transverse direction opposite said first transverse direction;

wherein said third port portion extends away from said first end of said second strip approximately in said second transverse direction; and wherein said further portion extends away from said second via approximately in said first transverse direction.

12. A method of making a coupler, comprising the steps of:

forming a dielectric layer using a thick film technique, said dielectric layer having first and second sides;

forming a first strip which is electrically conductive using a thick film technique, said first strip being disposed on said first side of said dielectric layer;

forming a second strip which is electrically conductive using a thick film technique, said second strip being disposed on said first side of said dielectric layer, and said first and second strips extending approximately parallel to each other;

forming first and second port portions coupled to said first strip and extending away from said second strip, said first and second port portions being wider than said first strip;

forming third and fourth port portions coupled to said second strip and extending away from said first strip, said third and fourth port portions being wider than said second strip; and forming a shield which is electrically conductive using a thick film technique, said shield being disposed on said second side of said dielectric layer in alignment with said first and second strips.

13. A method according to claim 12, including the step of providing a substrate;

wherein said steps of forming said first and second strips includes the step of forming said strips on said substrate;

wherein said step of forming said dielectric layer includes the step of forming said dielectric layer over said substrate and said strips; and wherein said step of forming said shield includes the step of forming said shield over said dielectric layer.

14. A method according to claim 12, including the step of providing a substrate;

wherein said step of forming said shield includes the step of forming said shield on said substrate;

wherein said step of forming said dielectric layer includes the step of forming said dielectric layer over said substrate and said shield; and wherein said steps of forming said first and second strips includes the step of forming said strips over said dielectric layer.

15. A method of making a coupler, comprising the steps of:

forming a dielectric layer using a thick film technique, said dielectric layer having first and second sides;

forming a first strip which is electrically conductive using a thick film technique, said first strip being disposed on said first side of said dielectric layer;

forming a second strip which is electrically conductive using a thick film technique, said second strip being disposed on said first side of said dielectric layer, and said first and second strips extending approximately parallel to each other;

forming a shield which is electrically conductive using a thick film technique, said shield being disposed on said second side of said dielectric layer in alignment with said first and second strips;

providing a substrate;

wherein said step of forming said shield includes the step of forming said shield on said substrate;

wherein said step of forming said dielectric layer includes the step of forming said dielectric layer over said substrate and said shield;

wherein said steps of forming said first and second strips includes the step of forming said strips over said dielectric layer;

including the step of forming a further dielectric layer using a thick film technique so that said first and second strips are disposed between said dielectric layers; and including the step of forming a further shield using a thick film technique, said further shield being disposed on a side of said further dielectric layer opposite from said substrate and in alignment with said first and second strips.

* * * * *